United States Patent [19]

Schmitt-Matzen

[11] Patent Number: 5,065,128

[45] Date of Patent: Nov. 12, 1991

[54] HERMETICALLY SEALED HIGH-PRESSURE SOLENOID COIL AND METHOD

[76] Inventor: Eric J. Schmitt-Matzen, P.O. Box 1418, Newport News, Va. 23601

[21] Appl. No.: 627,686

[22] Filed: Dec. 14, 1990

[51] Int. Cl.[5] ..... H01F 5/00

[52] U.S. Cl. ..... 335/299; 29/602.1; 336/722

[58] Field of Search ..... 335/299; 29/602.1, 605; 336/222, 223

[56] References Cited

U.S. PATENT DOCUMENTS

| | | | |
|---|---|---|---|
| 3,043,994 | 7/1962 | Anderson et al. | 335/299 |
| 3,076,919 | 2/1963 | Hamilton et al. | 335/299 |
| 3,451,021 | 6/1969 | Atherton | 335/299 X |

*Primary Examiner*—George Harris

[57] ABSTRACT

A solenoid coil is fabricated by precisioin winding a length of bondable magnet wire on a mandrel, heating and axially compressing the precision-wound convolutions to cause the bondable insulation to deform into a unitary, void-free mass, but without deforming the pre-existing circular cross section of the conductive metal core of the wire, and allowing the wire to cool such that the mass immovably captures the convolutions of the conductive core to thereby form a free-standing coil. The coil is then disposed in a mold cavity where the entirety of the coil is encapsulated. This produces a solenoid coil that is well-suited for use in high-pressure "wet" environments because the encapsulated assembly is strong and leak-proof. The encapsulant may be molded in such a manner as to have no seams extending from its surface to the winding.

14 Claims, 2 Drawing Sheets

HERMETICALLY SEALED HIGH-PRESSURE SOLENOID COIL AND METHOD

FIELD OF THE INVENTION

This invention relates to a method of making a coil for a solenoid and to a solenoid coil made by the method.

BACKGROUND AND SUMMARY OF THE INVENTION

Solenoids are sometimes used in "hostile" interior environments within certain devices. An example of a hostile interior environment is the inside of the body of a solenoid valve which controls pressurized hydraulic fluid. Internal pressures as high as several thousand psi are often encountered. The solenoid must be constructed to withstand the rigors of such usage by continuing to operate properly over its lifetime, and it must also remain sealed to the valve body so that fluid does not leak past the solenoid to the valve's exterior. It is also vital for the solenoid to remain unaffected by the high pressure fluid environment.

A typical coil previously used in high pressure solenoid valves involves the winding of magnet wire onto a plastic bobbin. The construction may include some sort of metal sleeve or an extremely thick walled bobbin for strengthening the coil against the large hoop stresses the solenoid may experience due to its exposure to high pressure hydraulic fluid. These prior solenoid coils are also typically encapsulated to protect their windings from the hydraulic fluid. Disadvantages of prior solenoid coils include the following.

When a coil winding and bobbin sub-assembly is encapsulated, the encapsulant may fail to attain a hermetic seal because it does not adequately bond to the bobbin material. This creates voids that are actual or potential leak paths for the hydraulic fluid. Leakage of fluid to the winding can result in the magnet wire coating being attacked by the hydraulic fluid and becoming short-circuited. During the encapsulation process, the bobbin is subjected to the heat and pressure of molding, and the thermally and mechanically induced stresses can cause distortion and/or cracking of the bobbin. When a metal sleeve is used to strengthen the solenoid against hoop forces and/or to isolate a non-metallic bobbin from the hydraulic fluid, the sleeve itself may introduce a shorted turn effect that increases eddy current losses and therefore reduces the performance capabilities of the solenoid. The use of both a sleeve and a bobbin in combination with a coil, and the encapsulation thereof in a sub-assembly, tends to increase the package size of a solenoid contrary to the demands of the market for smaller size solenoids. If a coil is made by precision winding or layer winding magnet wire on a bobbin, very little hoop strength can be expected or gained from the winding itself because air gaps exist and they allow the turns to move: during the encapsulation process; when the coil is subjected to thermal changes during operation; and when the solenoid is subjected to high pressure usage. The use of a metal sleeve poses a manufacturing problem because it is cost-prohibitive to pinch trim both ends of the sleeve to size, and as a result it becomes more feasible to pinch trim one end and machine a chamfer on the other that will allow the O-ring seals that are needed for high-pressure sealing of the solenoid to the valve body to be inserted without damage.

The present invention relates to a new, unique, and cost-effective method of making a high-pressure solenoid coil that will exhibit those characteristics necessary for successful high pressure usage. One of those is a hermetically sealed coil. The specific methodology will be disclosed in the ensuing description which is accompanied by drawings. The disclosure presents a presently preferred embodiment in accordance with the best mode contemplated at the present time for carrying out the invention. Additional features and advantages may also be perceived by the reader as the disclosure proceeds.

DESCRIPTION OF THE PREFERRED EMBODIMENT

Figure 1:
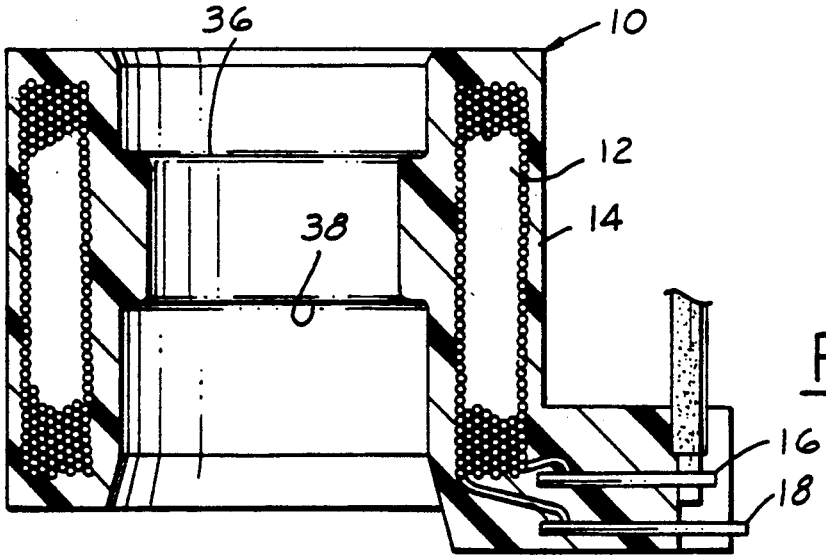
FIG. 1 is a longitudinal cross section through a solenoid coil made by the method of the present invention.

An example of a solenoid coil 10 that has been made in accordance with the inventive principles is presented in FIG. 1. Solenoid 10 comprises a coil winding 12, an enclosure 14, and two electrical terminals 16, 18.

The process of creating coil winding 12 leaves two terminations at opposite ends of the magnet wire. These two terminations are respectively electrically connected to appropriate connection points on the respective terminals 16, 18 by any conventional process. The portions of the terminals that are exterior to enclosure 14 may then be connected to wires that ultimately lead to the means for selectively energizing the solenoid coil.

Figure 2:
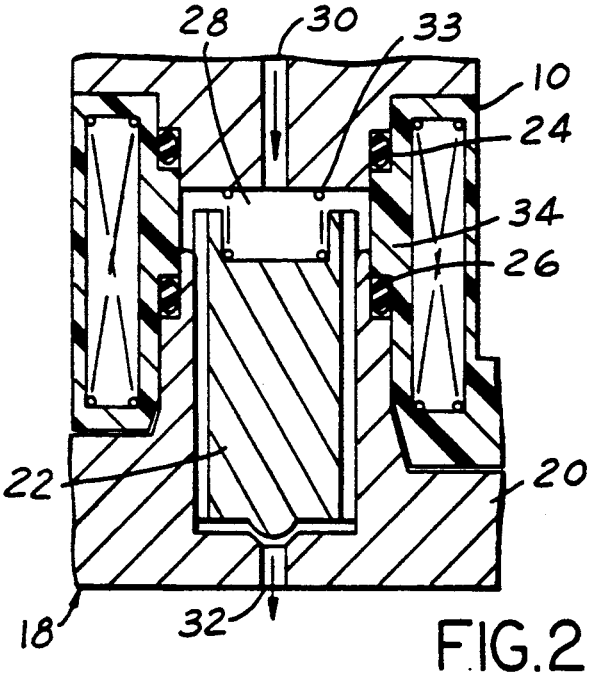
FIG. 2 is a longitudinal cross section through a portion of a high pressure solenoid valve including a solenoid coil made by the method of the present invention.

FIG. 2 shows a solenoid valve 18 containing solenoid coil 10. Valve 18 also comprises a valve body 20 and an armature 22. Valve body 20 comprises body parts constructed to provide a coil-receiving space within which solenoid coil 10 is disposed. Sealing of solenoid coil 10 to valve body 20 is accomplished by constructing both solenoid coil and valve body to form grooves for O-ring seals 24, 26 that seal off a high pressure zone 28 within the valve body. Armature 22 is disposed within zone 28 to control the flow of hydraulic fluid between an inlet 30 and an outlet 32. A spring 33 is also disposed in zone 28 and acts to bias armature 22 to close outlet 32 and hence close the fluid path from inlet 30 to outlet 32 to flow. When solenoid coil 10 is energized, armature 22 is displaced against the spring bias force to open the fluid path to flow. As can be seen from consideration of FIG. 2, solenoid coil 10 is exposed to the fluid pressure in zone 28 along that portion of the solenoid's I.D. that lies between O-rings 24, 26.

Enclosure 14 is constructed to have a circular cylindrical O.D., a circular cylindrical I.D., and circular annular end faces. It is further constructed to have a radially inwardly directed circular annular ledge 34 that provides a circular annular ledge surface 36 facing in a direction axially toward one of the circular annular end faces and a circular annular ledge surface 38 facing in a direction axially toward the other circular annular end face. Each ledge surface 36, 38 and the respective adjoining portion of the enclosure's I.D. form two sides of a corresponding four-sided circular annular groove for the corresponding O-ring 24, 26. The remaining two sides of each such groove are fashioned in valve body 20. Such a construction enables each O-ring to be assembled onto either the valve body or the coil before the valve body and coil sub-assembly are assembled together. Independently of locating the O-rings, ledge 34 serves to increase the hoop strength of the coil over a straight bore configuration by directing reinforcing compounds, such as glass fibers, in the encapsulant in an optimum orientation. Whether a ledge 34 is used in any given design depends upon application pressure requirements.

Figure 3:
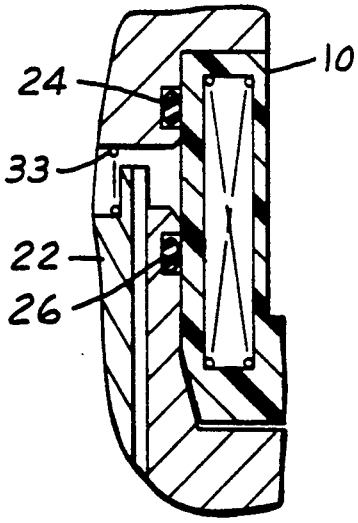
FIG. 3 is a view similar to FIG. 2, but fragmentary in nature, and of an alternate embodiment.

FIG. 3 illustrates an alternate embodiment where three of the four sides of each O-ring-receiving groove are fashioned in the valve body, and ledge 34 is omitted. In this embodiment, O-rings 24, 26 are assembled onto valve body 20 before the valve body and coil subassemblies are assembled together.

FIGS. 4–7 present in a semi-schematic manner a sequence of steps in the method of making solenoid coil 10. The first step shown in FIG. 4 comprises making coil winding 12 by winding a particular selected length of bondable magnet wire into a general circular cylindrical tubular shape on a mandrel 40. The length is chosen to yield a desired electrical resistance for the coil. The cross sectional proportions of the metal core and the insulation are chosen such that there is a sufficient amount of bondable insulation to accomplish the result hereinafter described. The winding operation is conducted by using conventional coil winding equipment. The bondable magnet wire is precision wound onto the mandrel, heated either internally and/or externally to make the insulation deformable, and then axially compressed in a means such as 42 to cause the wire convolutions to bond into essentially a unitary mass and thereby form a free-standing coil, but without deforming the pre-existing circular cross section of the conductive metal core of the wire. U.S. Pat. No. 3,348,183, contrary to the teaching of the present invention, shows the application of axial compression in an amount that deforms the cross section of the electrically conductive metal core of the wire, and such an extreme degree of axial compression is inappropriate to the practice of the present invention because the wire deformation alters the coil's electrical resistance. Moreover, U.S. Pat. No. 3,348,183 does not possess the proper proportions of wire and insulation to accomplish the result attained with the present invention.

Figure 4:
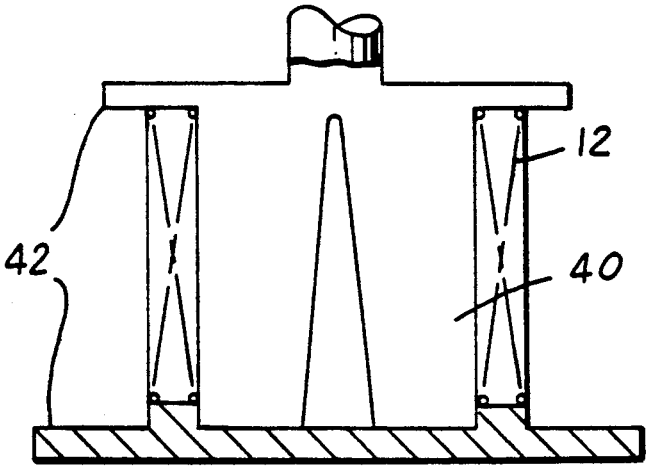
FIG. 4 is a longitudinal cross section illustrating a step of the method.
Figure 5:
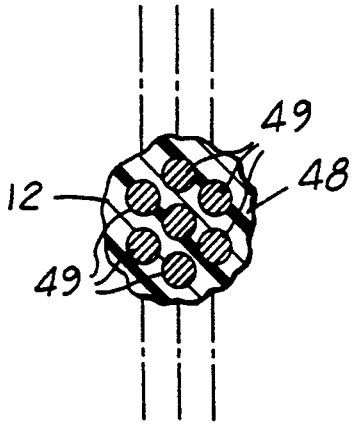
FIG. 5 is an enlarged fragmentary view in cross section illustrating certain coil details after the completion of the step of FIG. 4.

FIG. 5 shows a representative cross section through the coil winding after it has been made free-standing by the step of FIG. 4. It can be seen that the interior of the coil is free of voids, or air pockets, and that the bondable insulation has formed to a unitary mass 48 that captures the wire core's convolutions 49 such that they cannot move within the interior of the unitary mass.

Figure 6:
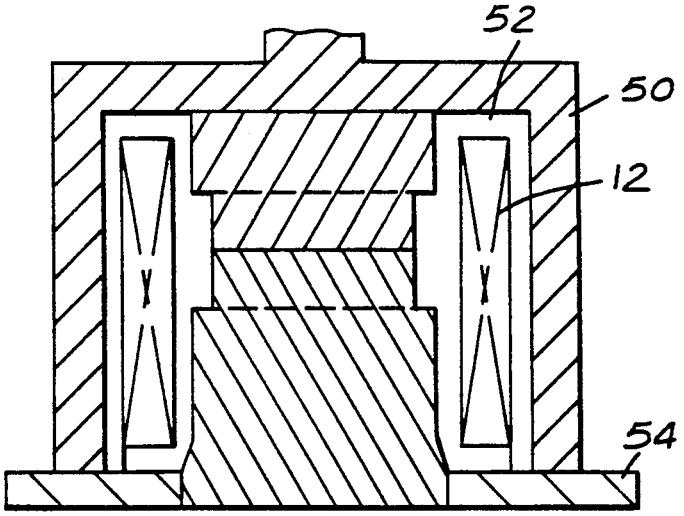
FIG. 6 is a cross section illustrating a further step of the method.

The next steps in the method of the present invention relate to the manner of fabricating enclosure 14. FIG. 6 shows the closed condition of a mold that defines a mold cavity 52 within which coil winding 12 is disposed. Mold cavity 52 is cooperatively defined by relatively movable parts 50, 54 of the mold. The construction of cavity 52 is such that the entire coil winding 12 is disposed in inwardly spaced relation to the walls of the cavity. The coil winding may be supported in any suitable manner; for example by retractable pins if "golf-ball" technology is used to fabricate enclosure 14; or for example by using suitably constructed terminals 16, 18.

Figure 7:
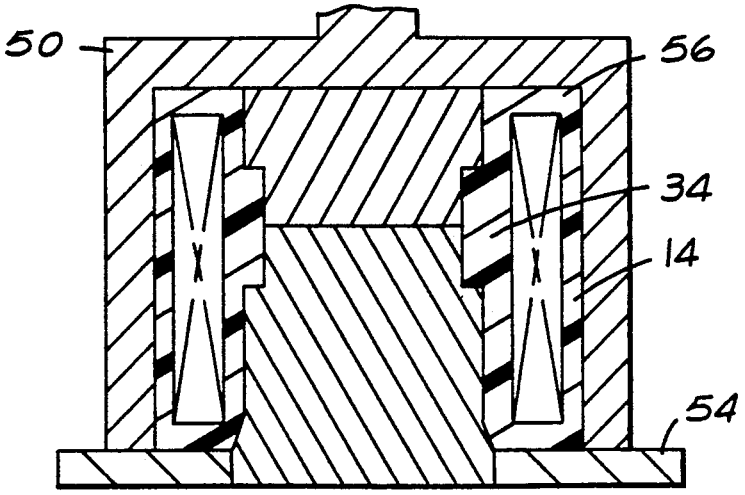
FIG. 7 is a cross section illustrating a further step of the method.

Flowable encapsulant is injected into cavity 52 to cause the encapsulant to be deposited in covering relation to the entirety of coil winding 12 in the manner presented in FIG. 7. The encapsulant is introduced into the cavity by conventional procedures employed in injection molding, and is allowed to cure to a solidified state portrayed in FIG. 7 by the reference numeral 56.

The reader should also appreciate that the encapsulating step is conducted in such a manner that the introduced encapsulant is caused to solidify without the creation of any seams extending from its exterior surface to the coil. The entirety of the coil winding is thereby heremetically sealed. When the coil is assembled into a valve body and subjected to high-pressure hydraulic fluid, such as in the exemplary manner of FIG. 2, there are no seams in the encapsulant that have the potential to form leak paths. Moreover, the molding is conducted with sufficient precision to assure the proper surface finish and dimensional control for those portions of the encapsulant's wall where the O-rings seals are seated.

The method that has been described is a cost-effective way to fabricate a solenoid coil that is to be used in a high-pressure, "wet" environment. By making coil winding 12 free-standing (i.e., bobbinless), the use of a bobbin and a sleeve is rendered unnecessary. Also, when the coil is encapsulated in this manner, no air gaps occur between the encapsulant and the coil winding, such as is the case with windings on a bobbin. This increases the hoop strength capabilities of the coil, especially when the encapsulant material includes reinforcing compounds, such as glass fibers. While a presently preferred embodiment of the invention has been illustrated and described, it is to be appreciated that the inventive principles may be practiced in other equivalent ways.

What is claimed as the invention is:

1. A method of making a solenoid coil which comprises:

fabricating a coil winding from a selected length of bondable magnet wire having a metal core of pre-existing cross section covered by bondable insulation of predetermined cross section and having terminations via which said coil winding can be electrically energized, including the steps of precision winding the length of magnet wire to form precision wound layers of convolutions, heating the magnet wire to make the insulation deformable, compressing the magnet wire, but without deforming the pre-existing cross section of the wire's metal core, to cause the predetermined cross section of the insulation to form into a void-free unitary mass that captures the wire's convolutions, and allowing the coil winding to cool such that the wire's convolutions are immovably captured within the void-free unitary mass of insulation;

placing the coil winding within mold cavity means such that the entirety of the coil winding is disposed within interior space means of said mold cavity means;

and injecting flowable encapsulant into said interior space means in covering relation to the entirety of the coil winding in such a manner that the encapsulant introduced thereby is caused to solidify without the creation of any voids between the encapsulant and the coil winding.

2. A method as set forth in claim 1 in which the step of placing the coil winding within mold cavity means comprises placing the entirety of the coil winding within a mold cavity of said mold cavity means in inwardly spaced relation to a wall of said mold cavity that bounds said interior space means, and the step of injecting flowable encapsulant into said interior space means comprises introducing the encapsulant in governing relation to the entirety of said coil winding such that the encapsulant does not create any seams extending from the exposed exterior surface of the encapsulant to the coil winding whereby the solenoid coil is hermetically sealed.

3. A method as set forth in claim 1 in which said solenoid coil is constructed to comprise for its exterior an inside diameter cylindrical face, an outside diameter cylindrical face, and annular end faces at axially opposite ends.

4. A method as set forth in claim 3 in which said encapsulant is molded to a shape to comprise annular ledge means for axially locating O-ring sealing means, and including the step of disposing and axially locating O-ring sealing means on said encapsulant by said annular ledge means.

5. A method as set forth in claim 4 in which said annular ledge means is molded to a shape to comprise a pair of ledge surfaces facing in opposite axial directions and said O-ring sealing means comprises a pair of O-ring seals each located by a respective one of said ledge surfaces.

6. A method as set forth in claim 5 in which said ledge means is molded to a shape to extend radially inwardly of a cylindrical inside diameter surface of the encapsulant.

7. A method as set forth in claim 3 in which said encapsulant is molded to a shape to comprise annular ledge means.

8. A solenoid coil made by the method of claim 1.

9. A solenoid coil made by the method of claim 2.

10. A solenoid coil made by the method of claim 3.

11. A solenoid coil made by the method of claim 4.

12. A solenoid coil made by the method of claim 5.

13. A solenoid coil made by the method of claim 6.

14. A solenoid coil made by the method of claim 7.

* * * * *